US011004436B2

(12) United States Patent
Heyne et al.

(10) Patent No.: US 11,004,436 B2
(45) Date of Patent: May 11, 2021

(54) METHOD FOR ACTIVE NOISE REDUCTION IN AN ELECTRIC OR HYBRID VEHICLE AND A CORRESPONDINGLY EQUIPPED VEHICLE

(71) Applicant: Dr. Ing. h.c. F. Porsche Aktiengesellschaft, Stuttgart (DE)

(72) Inventors: Raoul Heyne, Wiernsheim (DE); Alexander Schneider-Schaper, Wiernsheim (DE)

(73) Assignee: Dr. Ing. h.c. F. Porsche Aktiengesellschaft

( * ) Notice: Subject to any disclaimer, the term of this patent is extended or adjusted under 35 U.S.C. 154(b) by 1 day.

(21) Appl. No.: 16/775,328

(22) Filed: Jan. 29, 2020

(65) Prior Publication Data

US 2020/0243060 A1 Jul. 30, 2020

(30) Foreign Application Priority Data

Jan. 30, 2019 (DE) ..... 102019102248.7

(51) Int. Cl.
*G10K 11/178* (2006.01)

(52) U.S. Cl.
CPC .. *G10K 11/17823* (2018.01); *G10K 11/17873* (2018.01); *G10K 2210/1282* (2013.01); *G10K 2210/3044* (2013.01); *G10K 2210/3046* (2013.01)

(58) Field of Classification Search
USPC ..... 381/58, 66, 71.1, 71.4, 86, 302, 389
See application file for complete search history.

(56) References Cited

U.S. PATENT DOCUMENTS

| | | | | |
|---|---|---|---|---|
| 10,156,637 | B2 * | 12/2018 | Kim | G10K 11/17827 |
| 2020/0066246 | A1 * | 2/2020 | Von Elling | G06T 7/97 |
| 2020/0135167 | A1 * | 4/2020 | Kano | G10K 11/17854 |

* cited by examiner

*Primary Examiner* — Yosef K Laekemariam
(74) *Attorney, Agent, or Firm* — RatnerPrestia

(57) ABSTRACT

A method for active noise reduction in an electric or hybrid vehicle includes (i) detecting noise in an area surrounding the vehicle by at least one sound recording apparatus which is attached to the vehicle, and (ii) generating anti-phase sound by at least one sound output apparatus, which is attached to the vehicle, depending on a signal recorded by the sound recording apparatus. The generated anti-phase sound is generated with respect to a portion of the noise in the area surrounding the vehicle and is output into the area surrounding the vehicle. Also described is a corresponding electric or hybrid vehicle which is designed to perform active noise reduction with respect to its ambient noise.

11 Claims, 1 Drawing Sheet

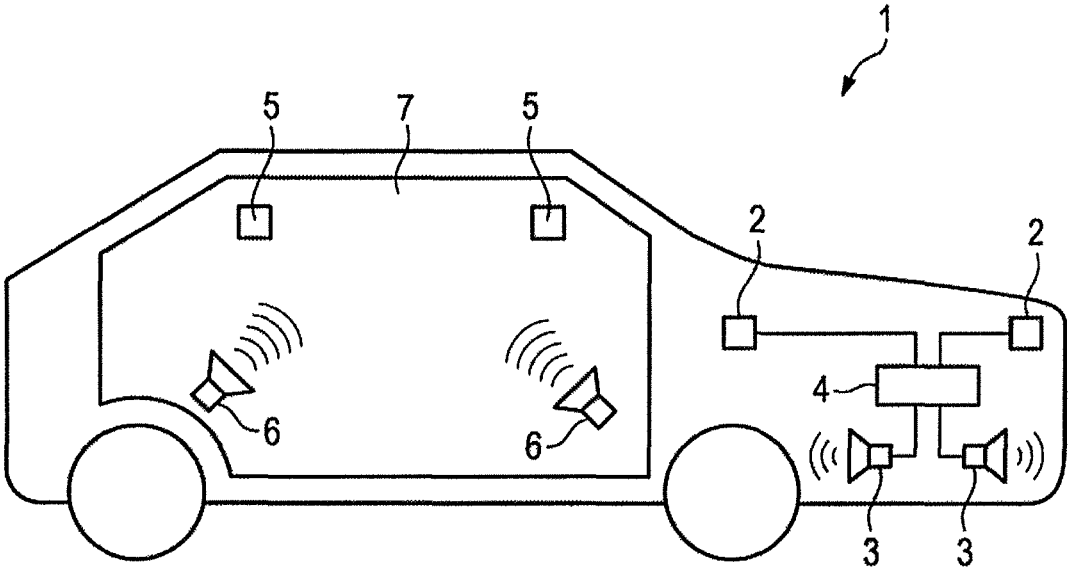
1
5
7
5
2
2
4
6
6
3
3

METHOD FOR ACTIVE NOISE REDUCTION IN AN ELECTRIC OR HYBRID VEHICLE AND A CORRESPONDINGLY EQUIPPED VEHICLE

CROSS-REFERENCE TO RELATED APPLICATION

This application claims priority to German Patent Application No. 10 2019 102 248.7, filed Jan. 30, 2019, the content of such application being incorporated by reference herein in its entirety.

FIELD OF THE INVENTION

The present invention relates to a method for active noise reduction in an electric or hybrid vehicle, and also to a corresponding vehicle which is designed to perform active noise reduction with respect to its ambient noise.

BACKGROUND OF THE INVENTION

As the number of electric and hybrid vehicles increases, the charging infrastructure required for operating these vehicles is also continuously extended in association. The various charging stations which are used worldwide firstly employ a modular charging concept in which a zo charging station comprising spatially separated components/modules is constructed, for example comprising a cooling unit and a power electronics unit as separate modules and at least one charging post which is coupled to these two modules. In this case, the charging post has, from the customer's point of view, substantially only a charging cable and a user interface and is "supplied" with a charging power, which is required for the charging process, and cooling power from a distance as it were. A construction of this kind has the advantage that, owing to the relocation of the power and cooling equipment away from the site of the charging post, the customer is not disturbed by noise which is generated while providing the power (for example by a transformer) or while dissipating the resultant heat (for example by fans or a compressor). However, most charging stations, primarily those in densely populated areas such as town centers, are usually not constructed from spatially separated components owing to a lack of space amongst other things. In this case, the charging process takes place, from a customer's point of view, directly at a switchgear cabinet or housing in which both the power electronics and also the cooling unit are accommodated and to which the charging cable and the user interface are also attached. As a result, the development of noise by the cooling arrangement or the power electronics system during charging is audible to the customer.

However, in general, efforts are made, irrespective of the type of construction of the charging station, to not subject the customer to noise when they are in the vicinity of a charging post while charging their electric or hybrid vehicle. This applies, in particular, to customers in the upper and top price segment of electric vehicles. Short charging times, which can be achieved only by high charging powers, play an important role in said high-price vehicle segment in particular. Since the voltage is currently limited to approximately 1 kV during rapid charging of electric and hybrid vehicles for safety reasons, this limiting is compensated for by very high charging currents in the region of 500 A. High currents in turn cause intense heating of the electronic and electrical components such as connectors, battery and the lines thereof, the entire power electronics system and possibly the fuses and freewheeling diodes. This waste heat has to be dissipated, and therefore corresponding cooling has to be provided. This relates, in particular, to the battery in the charging vehicle. Strong fans, with which a development of noise is associated, are usually used for the purpose of dissipating heat from the traction battery. Particularly at warm ambient temperatures, the fans can generate a loud background noise of unpleasant pitch which can have a hugely disturbing effect on a user in the vicinity of the charging post or in the vehicle.

SUMMARY OF THE INVENTION

In the abovementioned charging solutions in which the charging station is constructed from physically separated components, the noise-developing components, primarily the power electronics system and the cooling arrangement, are erected so far away from the charging posts that they do not disturb the customer in the region of the charging post. Therefore, the focus of preventing disturbing noise during charging is shifted to the vehicles themselves, in which vehicles the vehicle fans which are used for cooling the traction battery create noise and therefore constitute the loudest components which can disturb the user during charging. In turn, this means that the distributed charging solution of a charging park is not necessarily required in order to configure the charging processes to subject customers to as little noise as possible if the vehicles themselves constitute the greatest source of noise.

Proceeding from the above, it would be desirable to eliminate or at least to reduce, in particular, the background noise which is associated with a charging process for an electric or hybrid vehicle.

In the following description, reference is made to an electric vehicle, but this should always be understood to mean a hybrid vehicle too. Furthermore, active noise reduction is understood to mean damping or elimination of noise by means of anti-phase sound within the scope of this description.

Described herein is a method for active noise reduction in an electric vehicle, which method comprises detecting noise in an area surrounding the vehicle by means of at least one sound recording apparatus which is attached to the vehicle and generating anti-phase sound by means of at least one sound output apparatus, which is attached to the vehicle, depending on a signal recorded by the sound recording apparatus, wherein the anti-phase sound is generated with respect to at least a portion of the noise in the area surrounding the vehicle and is output into the area surrounding the vehicle and preferably into said vehicle. Detecting noise and generating anti-phase sound in relation to at least a portion of the noise can be performed, in particular, with respect to an area surrounding the vehicle, which area contains the vehicle itself.

Therefore, by means of the method, pollution of the area surrounding the vehicle with noise which is generated by the vehicle itself can be reduced or even entirely prevented by emitting anti-phase sound. Consequently, the method provides active noise reduction in the area surrounding the vehicle, wherein the primary objective of the method is damping or eliminating the noise which is generated by the vehicle itself. In particular, the method can be used for preventing noise which is generated by an electric vehicle during charging of a traction battery of said electric vehicle. Since the fans of a charging vehicle are the loudest components during the charging process, the background noise which is generated by said fans is reduced or eliminated by means of the present method, as a result of which the charging process again becomes very quiet overall, analogously to driving in an electric vehicle itself. Since the currently prevailing background noise is detected and a corresponding anti-phase sound is generated during the course of the method in every case, it is therefore possible to react to a change in the fan noise, for example on account of soiling, icing up or a change in rotation speed. A reduction in noise which is matched to the current situation, in particular a reduction in noise which is matched to the current state of the sources of noise, can be provided by means of the method according to the invention. By way of detecting noise in an area surrounding the vehicle, the generated anti-phase sound can at the same time also be matched to dynamic spatially structural changes in the area surrounding the vehicle which change the background noise around the vehicle. Therefore, for example, a heavy goods vehicle coming to a stop next to the charging vehicle during a charging process or a truck loaded with hay can change the spatial conditions in such a way that the background noise prevailing in the region of the vehicle is changed due to a change in the reflection of sound. By means of the method according to the invention, the background noise is detected in real time at the vehicle and the anti-phase sound can accordingly be matched to a structurally changing surrounding area in real time, and therefore optimum noise suppression always takes place. In particular, the charging noise can be reduced by means of the method described here at least to the extent that emission values (in particular during the night when the majority of vehicles are usually charged) in residential areas, skiing areas and, for example, in the region of hospitals and care homes are complied with.

The sound recording apparatus used within the scope of the method may be a microphone and the sound output apparatus may be a loudspeaker. The anti-phase sound is generated with respect to at least a portion of the noise in the area surrounding the vehicle and is output into the area surrounding the vehicle and preferably into said vehicle, wherein the portion can comprise the background noise prevailing at the or around the vehicle, in particular the charging noise. The primary purpose of the present method is to eliminate or at least to suppress the noise pollution caused by the vehicle during the charging process, and not to provide general suppression or elimination of all of the background noise at the charging vehicle even though the latter can likewise be achieved by means of the present method. To this end, the anti-phase sound is then calculated and output with respect to the entire recorded spectrum of noise.

In particular, the noise which is produced at vehicle components during the charging process in the area surrounding the charging vehicle can be suppressed or eliminated by means of the method described here (and in a vehicle correspondingly designed in accordance with said method). Here, the suppression of noise is not restricted only to the fans of the vehicle but can also cover further components which generate noise, for example humming converters. Since the noise which is generated by the charging process around the vehicle is damped or eliminated, the noise which is caused by the charging process in the interior of the vehicle is, however, also damped to a certain extent by means of the method described here.

According to further embodiments, the method can further comprise processing the detected noise by means of a control unit for generating an actuation signal for the sound output apparatus. The (audio) control unit may be an audio unit which has an amplifier and actuates the at least one sound output apparatus by means of correspondingly calculated signals in order to generate the anti-phase sound which is required for active sound reduction. In this sense, the control unit can simultaneously also be considered to be an evaluation unit in respect of the detected sound.

According to further embodiments of the method, the control unit can correspond to an acoustics generating module which is already present in the vehicle, in particular the sound generator which is usually already present in an electric vehicle. The sound generator is usually used for simulating/generating driving noise at low speeds so that other road users, in particular pedestrians and cyclists, better perceive the electric vehicle. Owing to the use of the sound generator for generating the anti-phase sound, costs, weight and installation space, which is usually scarce in vehicles in any case, for an audio module which is otherwise additionally required can be saved.

In a further embodiment, an existing anti-phase sound installation for noise reduction for the interior during charging can be used, while a corresponding (audio) control unit can be implemented in the vehicle for the outwardly directed active noise suppression.

According to further embodiments of the method, the anti-phase sound can be generated only with respect to at least one predetermined frequency band of the noise which is detected in the area surrounding the vehicle. To this end, for example, the actuation signal (for generating the anti-phase sound) which is transmitted by the control unit to the sound output apparatus and/or the signal which is transmitted by the sound recording apparatus to the control unit and represents the background noise at the vehicle can be filtered in an appropriate manner, for example by means of at least one bandpass filter. As a result, it is possible for the noise of nature in the surroundings of the area for charging, for example birdsong, to not be covered by the active noise suppression. Furthermore, frequency stopbands which are excluded from the active sound damping can also be prespecified within the scope of the method. The frequency stopbands can be defined, for example, on the basis of the sound ranges of the sirens of police vehicles, ambulances and fire department vehicles. According to further embodiments of the method, the at least one predetermined frequency band with respect to which the anti-phase sound is generated can be defined by the noise which is produced during charging of the vehicle. The target frequency bands for the active noise suppression can be determined, for example, on the basis of expected values for sound emission frequencies of the noise-generating components, for example the fans of the vehicle. The expected values can correspond to factory-set values at which, in addition, both the influence of the vehicle body and also a certain fluctuation bandwidth due to changed operating parameters (icing up, soiling, rotation speed) of the fans has been taken into account.

According to further embodiments, the method can further comprise adjusting the sound pressure of the generated anti-phase sound depending on the sound pressure of the noise in the at least one predetermined frequency band. In this way, the emission of noise can be reduced to such an extent that guideline emission values (predominantly during the night since the majority of vehicles are usually charged at this time) in residential areas, skiing areas and, for example, in the region of hospitals and care homes are complied with. In the process, it is possible to take into account that electric vehicles which are connected to charging posts can be interpreted in combination as stationary installations and as a result stricter requirements in respect of the guideline emission values can be produced in respect of a single vehicle in the combination.

A vehicle which is designed in accordance with the above-described method is provided in further exemplary embodiments. Consequently, a vehicle with active ambient noise reduction is provided, the vehicle being an electric or hybrid vehicle. The vehicle comprises at least one sound recording apparatus which is attached to the vehicle and is designed to detect noise in an area surrounding the vehicle, which noise the vehicle itself can contain in particular, and at least one sound output apparatus which is attached to the vehicle and is designed to output sound to the ambient area surrounding the vehicle and preferably is arranged in said vehicle too. The vehicle further has a control unit which is coupled to the sound recording apparatus and to the sound output apparatus and is designed to actuate the sound output apparatus, depending on a signal recorded by the sound recording apparatus, in such a way that said sound output apparatus outputs an anti-phase sound to a portion of the detected noise.

According to further exemplary embodiments of the vehicle with active ambient noise reduction, the control unit can be designed to actuate the sound output apparatus in such a way that the anti-phase sound is generated only with respect to at least one predetermined frequency band of the detected noise.

According to further exemplary embodiments of the vehicle with active ambient noise reduction, the at least one predetermined frequency band with respect to which the anti-phase sound is generated can be defined by the noise which is produced during charging of the vehicle.

Further advantages and refinements of the invention can be found in the description and the appended drawings.

It goes without saying that the features mentioned above and those still to be explained below can be used not only in the respectively indicated combination but also in other combinations or on their own, without departing from the scope of the present invention.

BRIEF DESCRIPTION OF THE DRAWING FIGURE

The sole FIGURE shows an electric vehicle which is configured for active noise reduction.

DETAILED DESCRIPTION OF THE INVENTION

The invention will be explained with reference to the appended FIGURE which shows an electric vehicle 1 which is designed for active noise reduction by means of the method presented here. The vehicle 1 has a number of microphones 2 (only two are shown here by way of example) which are coupled to an (audio) control unit 4. The vehicle 1 additionally has external loudspeakers 3 which are likewise coupled to the control unit 4. The system comprising the microphones 2, the external loudspeakers 3 and the control unit 4 forms the basis of the method for active noise reduction in an electric or hybrid vehicle. The background noise in the area surrounding the vehicle 1 is acoustically imaged by means of the microphones 2 and processed by the control unit 4. The control unit 4 then actuates the external loudspeakers 3, so that said external loudspeakers output an anti-phase sound which damps or eliminates at least a portion of the background noise surrounding the vehicle 1. Even though the components are all illustrated in the front of the vehicle 1, both the microphones 2 and also the external loudspeakers 3 can be present in a greater number and additionally can also be fitted at different locations in the vehicle 1.

The control unit 4, including external loudspeakers 3, may be a system for simulating and outputting driving noise (driving noise simulator) which is already implemented in the vehicle 1.

The vehicle 1 can preferably be equipped with a system for active driving noise damping in the interior of the vehicle 7. Analogously to the system, said system comprises microphones 5 and loudspeakers 6 which are arranged in the passenger compartment 7 and can be coupled to an audio unit (not illustrated in the FIGURE). The control unit 4 can preferably constitute an audio unit which is common to both systems.

What is claimed:

1. A method for active noise reduction in an electric or hybrid vehicle, said method comprising:

detecting noise in an area surrounding the vehicle by means of at least one sound recording apparatus which is attached to the vehicle; and generating anti-phase sound by means of at least one sound output apparatus, which is attached to the vehicle, depending on a signal recorded by the sound recording apparatus, wherein the generated anti-phase sound is generated with respect to a portion of the noise in the area surrounding the vehicle and is output into the area surrounding the vehicle.

2. The method for active noise reduction as claimed in claim 1, further comprising:

processing the detected noise by means of a control unit for generating an actuation signal for the sound output apparatus.

3. The method for active noise reduction as claimed in claim 2, wherein the control unit is an acoustics generating module which is already present in the vehicle.

4. The method for active noise reduction as claimed claim 1, wherein the anti-phase sound is generated only with respect to at least one predetermined frequency band of the noise which is detected in the area surrounding the vehicle.

5. The method for active noise reduction as claimed in claim 4, wherein the at least one predetermined frequency band with respect to which the anti-phase sound is generated is defined by the noise which is produced during charging of the vehicle.

6. A method for active noise reduction in an electric or hybrid vehicle, said method comprising:

detecting noise in an area surrounding the vehicle by means of at least one sound recording apparatus which is attached to the vehicle; and generating anti-phase sound by means of at least one sound output apparatus, which is attached to the vehicle, depending on a signal recorded by the sound recording apparatus, wherein the generated anti-phase sound is generated with respect to a portion of the noise in the area surrounding the vehicle and is output into the area surrounding the vehicle, wherein the anti-phase sound is generated only with respect to at least one predetermined frequency band of the noise which is detected in the area surrounding the vehicle; and adjusting a sound pressure of the generated anti-phase sound depending on the sound pressure of the noise in the at least one predetermined frequency band.

7. An electric or hybrid vehicle with active ambient noise reduction, said electric or hybrid vehicle comprising:

at least one sound recording apparatus which is attached to the vehicle and is configured to detect noise in an area surrounding the vehicle;

at least one sound output apparatus which is attached to the vehicle and is configured to output sound to the ambient area surrounding the vehicle;

a control unit which is coupled to the sound recording apparatus and to the sound output apparatus and is configured to actuate the sound output apparatus depending on a signal recorded by the sound recording apparatus, in such a way that said sound output apparatus outputs an anti-phase sound to a portion of the detected noise.

8. The electric or hybrid vehicle as claimed in claim 7, wherein the control unit is configured to actuate the sound output apparatus in such a way that the anti-phase sound is generated only with respect to at least one predetermined frequency band of the detected noise.

9. The electric or hybrid vehicle as claimed in claim 8, wherein the at least one predetermined frequency band with respect to which the anti-phase sound is generated is defined by the noise which is produced during charging of the vehicle.

10. The method for active noise reduction as claimed in claim 1, wherein the at least one sound output apparatus is located outside of a passenger cabin of the vehicle.

11. The electric or hybrid vehicle as claimed in claim 7, wherein the at least one sound output apparatus is located outside of a passenger cabin of the vehicle.

* * * * *